US011398177B2

(12) United States Patent
Tseng et al.

(10) Patent No.: US 11,398,177 B2
(45) Date of Patent: Jul. 26, 2022

(54) PULSE-WIDTH DRIVEN PIXEL UNIT AND DISPLAY DEVICE HAVING A DISPLAY MEDIUM MODULE DISPOSED ON A SUBSTRATE OF A PIXEL CIRCUIT OF THE PIXEL UNIT

(71) Applicant: Shih-Hsien Tseng, Hsinchu (TW)

(72) Inventors: Shih-Hsien Tseng, Hsinchu (TW); Chih-Wen Lu, Hsinchu (TW)

(73) Assignee: Shih-Hsien Tseng, Hsinchu (TW)

( * ) Notice: Subject to any disclaimer, the term of this patent is extended or adjusted under 35 U.S.C. 154(b) by 0 days.

(21) Appl. No.: 17/316,658

(22) Filed: May 10, 2021

(65) Prior Publication Data

US 2021/0366345 A1 Nov. 25, 2021

(30) Foreign Application Priority Data

May 20, 2020 (TW) ..... 109116724

(51) Int. Cl.
*G09G 5/10* (2006.01)
*G09G 3/20* (2006.01)
(Continued)

(52) U.S. Cl.
CPC ..... *G09G 3/2007* (2013.01); *G09G 3/2014* (2013.01); *G09G 3/3258* (2013.01);
(Continued)

(58) Field of Classification Search
CPC ..... G09G 3/2007; G09G 2300/08; G09G 2310/0243; G09G 2310/0267;
(Continued)

(56) References Cited

U.S. PATENT DOCUMENTS 7,106,351 B2 * 9/2006 Ito ..... G03B 21/16 345/692
8,077,189 B2 12/2011 Ishida
(Continued)

FOREIGN PATENT DOCUMENTS

CN 1885377 A 12/2006
CN 101640035 A 2/2010
CN 110400539 A 11/2019

OTHER PUBLICATIONS

"International Search Report" dated Jan. 25, 2022 for International application No. PCT/CN2021/093049, International filing date: May 11, 2021.

*Primary Examiner* — Adam J Snyder
(74) *Attorney, Agent, or Firm* — Winston Hsu

(57) ABSTRACT

A pixel circuit and a display device using a pulse width modulation generator are provided. The pixel circuit has a data latch; and a pulse width modulation (PWM) generator, which is electrically coupled to the data latch, a scan line and a counter; wherein, the pulse width modulation generator is based on the pixel data, the scan signal and a counter code generated by the counter to generate a pulse width modulation (PWM) signal. Therefore, the pixel signal can be generated in a voltage and/or current mode according to the PWM signal and connected to the corresponding pixel electrode of the pixel display medium module, so that the period time for driving the display medium by accurately controlling the voltage and/or current to precisely provide grayscale function of the display.

21 Claims, 14 Drawing Sheets

(51) Int. Cl.

| | |
|---|---|
| *G09G 3/3291* | (2016.01) |
| *G09G 3/3258* | (2016.01) |
| *G09G 3/36* | (2006.01) |

(52) U.S. Cl.

CPC ..... *G09G 3/3291* (2013.01); *G09G 3/3614* (2013.01); *G09G 3/3648* (2013.01); *G09G 3/3688* (2013.01); *G09G 2300/08* (2013.01); *G09G 2300/0823* (2013.01); *G09G 2300/0833* (2013.01); *G09G 2300/0838* (2013.01); *G09G 2300/0857* (2013.01); *G09G 2310/027* (2013.01); *G09G 2310/0243* (2013.01); *G09G 2310/0267* (2013.01); *G09G 2310/0275* (2013.01); *G09G 2310/0286* (2013.01); *G09G 2310/08* (2013.01); *G09G 2320/0233* (2013.01); *G09G 2330/02* (2013.01)

(58) Field of Classification Search

CPC ... G09G 2310/0275; G09G 2310/0286; G09G 2310/08; G09G 2320/0233; G09G 2330/02; G09G 3/2014; G09G 3/3291; G09G 3/3258; G09G 3/3688; G09G 2300/0823; G09G 2300/0833; G09G 2300/0838; G09G 2300/0857; G09G 2310/027

See application file for complete search history.

(56) References Cited

U.S. PATENT DOCUMENTS

| | | | | |
|---|---|---|---|---|
| 10,694,597 | B2 * | 6/2020 | Watsuda | G09G 3/3406 |
| 2003/0011552 | A1 * | 1/2003 | Ishii | G09G 3/3659 345/89 |
| 2004/0036968 | A1 * | 2/2004 | Ito | G03B 21/16 359/443 |
| 2004/0246202 | A1 * | 12/2004 | Yamashita | G09G 3/3258 345/30 |
| 2006/0238943 | A1 * | 10/2006 | Awakura | G09G 3/3258 361/93.1 |
| 2007/0046611 | A1 * | 3/2007 | Routley | G09G 3/3216 345/98 |
| 2008/0272276 | A1 | 11/2008 | Huang | |
| 2009/0134814 | A1 * | 5/2009 | Moon | H05B 45/44 315/294 |
| 2010/0026730 | A1 | 2/2010 | Okutani | |
| 2017/0039935 | A1 * | 2/2017 | Yang | G09G 3/3233 |
| 2017/0116906 | A1 * | 4/2017 | Tai | G09G 3/2014 |
| 2019/0327809 | A1 * | 10/2019 | Watsuda | G09G 3/3406 |

* cited by examiner

PULSE-WIDTH DRIVEN PIXEL UNIT AND DISPLAY DEVICE HAVING A DISPLAY MEDIUM MODULE DISPOSED ON A SUBSTRATE OF A PIXEL CIRCUIT OF THE PIXEL UNIT

BACKGROUND OF THE INVENTION

1. Field of the Invention

The present invention is related to a pixel circuit and a display device, and particularly to a digital driving pixel circuit and a display device using pulse-width generators.

2. Description of the Prior Art

With the advancement of technology, there is a great increase in demand for visual display and multimedia devices with compactness, high contrast, high dynamic, high color saturation, high aperture ratio, large-sized panel, low cost and low power consumption, high quality and easy maintenance.

The current display devices can be divided into self-luminous type and non-self-luminous types. Liquid crystal display (LCD) is currently the most popular type for non-self-luminous flat panel display device. The amount of light passing through a liquid crystal medium is modulated by controlling the voltage of the upper and lower electrodes of the liquid crystal medium. If the constant voltage is continuously applied to the lower and upper electrode of the liquid crystal, it is easy to cause the LCD image blur, and deterioration of the display quality. The characteristics of alternating voltage polarity reversal are usually used to apply the difference between the upper and lower electrodes alternating positive and negative polarity. The general liquid crystal display uses four inverted drive methods: frame inversion, row inversion, column inversion and dot inversion drive modes, and further combined employment of a color filter layer, a polarizer and some functional optical films, and backlight etc., to achieve the effect of color display.

Self-luminous flat panel display may be categorized into field emissive display, plasma display, electroluminescent display, photoluminescent display, organic light-emitting diode display and so on. In an organic light-emitting diode display (OLED), light-emitting polymers are deposited between an upper electrode layer and a lower electrode layer. With further employment of a conductive layer of electrons and holes, and the lighting display is generated by adding the electric field to move the carriers, resulting in electrons and the hole carrier recombination phenomenon. In comparison, an organic light-emitting diode display device is characterized by its wide viewing angle, fast responding speed, thin panel and flexibility; further, it requires neither backlighting nor color filter and may be made large-sized.

The display panel of both LCD and OLED devices has a plate of transparent glass for a substrate, directly and sequentially forming a thin-film transistor, a lower electrode layer, a display medium layer, an upper electrode layer and others thereon. The thin-film transistor may control the voltage or current imposed on the upper electrode layer and/or the lower electrode layer to control the state of the display medium.

In the above-mentioned display device, grayscale expression is realized by controlling a driving transistor of each pixel circuit and the magnitude of voltage or current supplied to a display medium. Different display pixel units in the display device, because of the threshold voltage of their respective driving thin-film transistors existing a deviation, a characteristic of the driving transistor varies, the grayscale expression cannot be precisely controlled the magnitude of the voltage or current, so that the grayscale differences are inconsistent when the image is displayed and induced the uneven brightness of the picture. In order to mitigate the influence of a variation in driving transistors on grayscale performance of the display, a new and precise digital driving pixel circuit and display device is provided to improve the performance of the display grayscale.

SUMMARY OF THE INVENTION

An embodiment provides a pulse width modulation voltage and/or current driven pixel circuit, which comprising a data latch coupled to a data line for receiving a pixel datum and a scan line for receiving a scan signal, and a pulse width modulation (PWM) generator coupled to the data latch, the scan line and a counter and configured to generate a PWM signal according to the pixel datum, the scan signal and a counter code generated by the counter, through precisely controlling the timing that voltage and/or current for driving the brightness of the pixel to accurately render the grayscale of the display.

Another embodiment provides a pulse width modulation voltage and/or current driven pixel circuit, which comprising a pulse width modulation (PWM) generator coupled to a scan line for receiving a scan signal, a data line for receiving a pixel datum, a start line for receiving a start signal of the (PWM) generator and coupled to a clock line for receiving a clock signal, according to the scan signal, start signal, clock signal and pixel data configured to generate a pulse width modulation (PWM) signal for precisely controlling the length of time that voltage and/or current driving pixel brightness to accurately render the grayscale of the display. The above-mentioned data latches, various pulse width modulation (PWM) generators and counters, etc. are made from a semiconductor manufacturing process (exposure, development, etching, diffusion, deposition, ion implantation, cleaning, inspection and other process steps) at least on the silicon wafer, III-V compound, glass, quartz, flexible organics, inorganics, metals, metal compounds, polymers, graphite substrate and the above combination thereof substrates.

Another embodiment provides a display device comprising a plurality of data lines, a source driver coupled to the plurality of data lines and configured to output pixel data to the plurality of data lines, a plurality of scan lines, a scan driver coupled to the plurality of scan lines and configured to output scan signals to the plurality of scan lines, and a plurality of pixel circuits. Each pixel circuit comprises a transistor coupled to a corresponding data line for receiving a pixel datum and a corresponding scan line for receiving a scan signal, and a data latch coupled to the transistor and configured to receive and latch the pixel datum.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
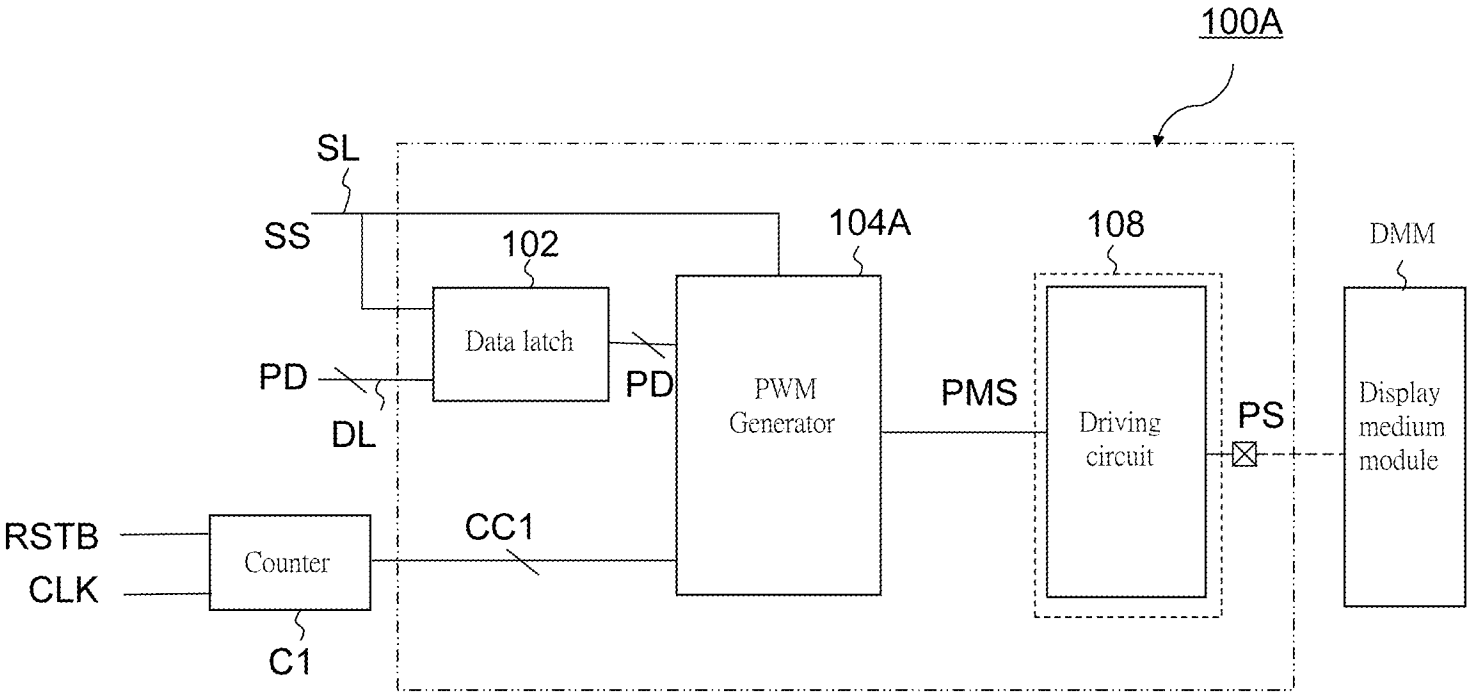
FIG. 1 is a diagram of a pixel circuit of an embodiment of the present invention.

The implementation method of the present invention will be further illustrated by way of the following description of a plurality of embodiments. But it should be noted that the embodiments described below are illustrative and exemplary only rather than limiting the application of the present invention to the described environment, application, structure, procedure or steps. Elements that are not directly related to the present invention are ignored from the drawings. The scale relations among elements in the drawings are illustrated rather than limiting of the actual scales of the present invention. Unless noted otherwise, identical (or similar) reference symbols correspond to identical (or similar) elements.

FIG. 1 is a diagram of a pixel circuit 100A of an embodiment of the present invention. The pixel circuit 100A can comprise a data latch 102 coupled to a data line DL for receiving a pixel datum PD and a scan line SL for receiving a scan signal SS, and a pulse width modulation (PWM) generator 104A coupled to the data latch 102, the scan line SL and a counter C1 and configured to generate a pulse width modulation (PWM) signal PMS according to the pixel datum PD, the scan signal SS and a counter generated counter code CC1. The data latch 102 controls the transmission of the pixel datum PD according the scan signal SS. The counter C1 can generate the counter code CC1 according to a clock signal CLK. Also, the counter C1 can receive a reset signal RSTB to start the counting cycle. Whenever, the PWM Generator 104A has sufficient driving capability to fully control the display state of the smaller loading of pixel electrode, the pulse width modulation signal PMS generated by PWM can be directly electrically coupled to the pixel display media module DMM. The pixel circuit 100A can further comprise a driving circuit 108 configured to generate a pixel signal PS for increasing driving capacity to control the display status of the larger loading pixel electrode E1 (refer to FIG. 7A/7B), the driving circuit 108 electrically coupled PWM generator 104A can comprise at least one of a CMOS (complementary metal oxide semiconductor), N-type and/or P-type MOS (Metal Oxide Semiconductor) transistors and above combination of thereof transistors in the driving circuits, and according to the PWM signal PMS, can generate pixel signal PS electrically coupled to the pixel electrode E1 of the pixel display media module DMM. The driving circuit 108 can select to use of voltage mode such as liquid crystal display medium or voltage-to-current mode, such as organic light-emitting diode OLED for delivering the pixel signal PS electively coupled to the pixel electrode of the display media module DMM according to the characteristics of the display media in the display medium module DMM, through precisely controlling the magnitude of voltage and/or current values to drive the display medium during a period of time for accurately rendering the gray-scale of the display.

Figure 1A:
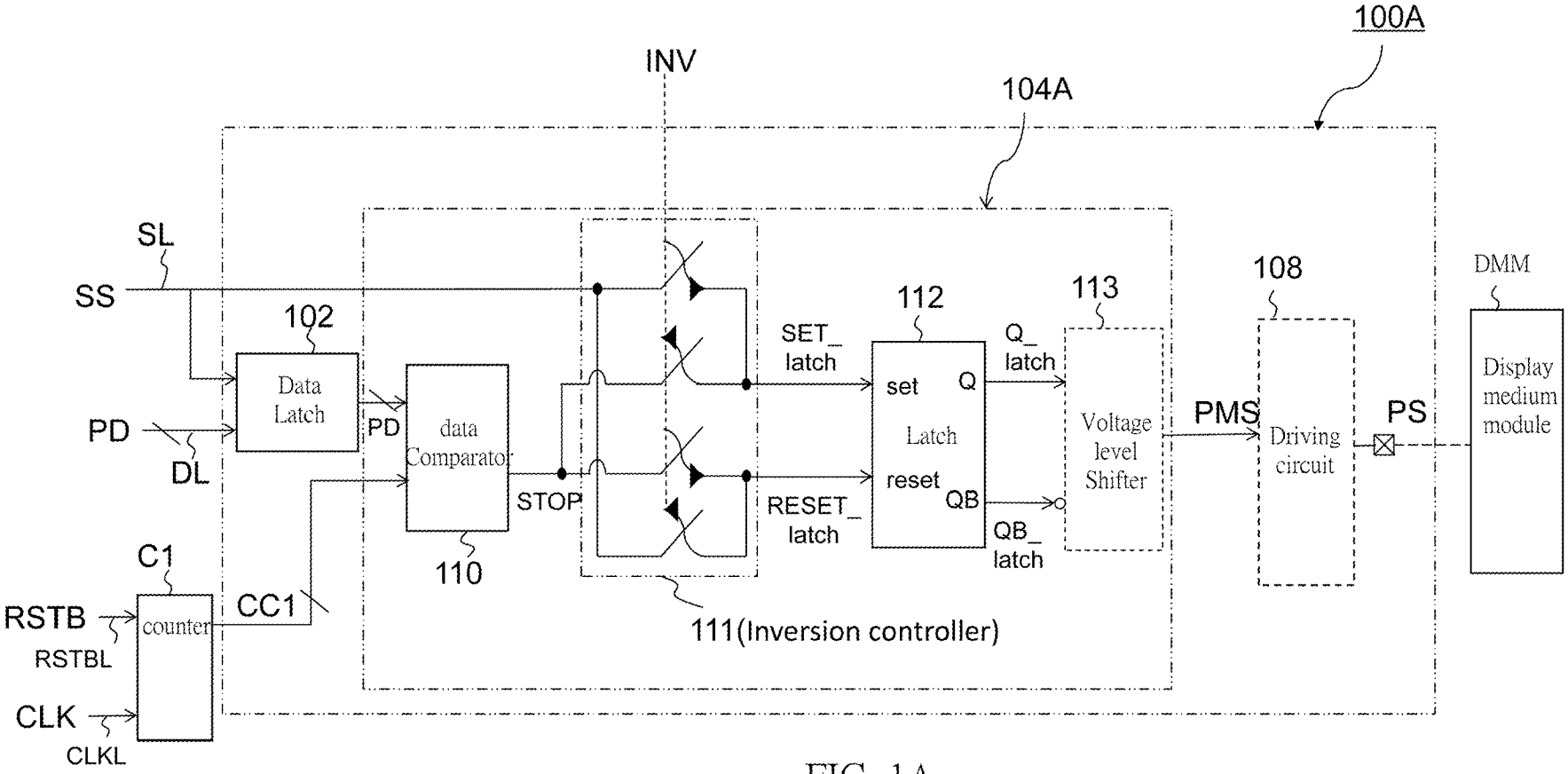
FIG. 1A is a detailed diagram of a pixel circuit of an embodiment of the present invention in FIG. 1.

FIG. 1A is a detailed diagram of a pixel circuit 100A of an embodiment of the present invention in FIG. 1. The PWM generator 104 comprises a data comparator 110, an inversion controller 111, a latch 112 and a voltage lever shifter 113. The supply voltage is used for data latch 102, counter C1, data comparator 110, inversion controller 111 and latch 112, etc. is the low supply voltage VDDL, and the supply voltage of the voltage lever shifter 113 is the high supply voltage VDDH. The Counter C1 is electrically coupled to the reset signal line RSTBL for receiving the reset signal RSTB and the clock signal line CLKL for receiving the clock signal CLK, and the counter code CC1 is generated according to the reset signal RSTB and clock signal CLK, and the counter code CC1 is sustainable increasing or decreasing counts, such as "0000000000" is CC1_0, "0000000001" is CC1_1, . . . and CC1_256 of "0100000000." . . . , CC1_512 "1000000000" . . . CC1_1023 is "1111111111", but not limited to this.

The inversion controller 111 of the embodiment pixel circuit 100A can be selectively using row, column and dot inversion frame mode to drive the lcd display. The data comparator 110 comprises a first input node electrically coupled to the data latch 102 for receiving the pixel datum PD, a second input node electrically coupled to the counter C1 for receiving the counter code CC1 and an output node for outputting a PWM stop signal STOP. The inversion controller 111 comprises a first input node electrically coupled to the scan line SL for receiving the scan signal SS, a second input node electrically coupled to the data comparator 110 for receiving the PWM stop signal STOP, the first output node for outputting a set signal SET_latch and the second output node for outputting a reset signal RESET_latch. The latch 112 comprises a set node electrically coupled to the inversion controller 111 for receiving the set signal SET_latch to start the signal PMS of the pulse width modulation PWM; a reset node electrically coupled to the inversion controller 111 for receiving the reset signal RESET_latch to stop the signal PMS of the pulse width modulation PWM. The first output node Q for outputting a latch signal Q_latch to a noninverting input node of the voltage level shifter 113 and the second output node QB for outputting an inverted latch signal QB_latch to an inverting input node of the voltage level shifter 113. The latch signal Q_latch is a PWM signal and the inverted latch signal is an inverted PWM signal. Whenever the voltage level of the latch signal Q_latch is large enough to fully control the state of the pixel electrode, the output node Q can be directly electrically coupled to the pixel display media module DMM, which is smaller pixel electrode loading (not shown in the drawing), or select the voltage level shifter 113 from a low power supply VDDL supply shift to the high supply voltage VDDH supply for increasing the driving voltage level capacity of the loading to control the display status of the higher loading of the pixel electrode E1 (refer to FIG. 7A/7B) in the display media module DMM. Further, another digital circuits, wherein comprises a set signal to activate the PWM signal and a reset the signal to terminate the PWM signal, can be used to generate the width of the PWM output signal PMS, not limited to use of latch 112 only for generating the width of the PWM output signal PMS. The level shifter 113 comprises a non-inverting input node electrically coupled to the latch 112 for receiving the latch signal Q_latch, an inverting input node electrically coupled to the latch 112 for receiving the inverted latch signal QB_latch and an output node electrically coupled to an driving circuit 108 for increasing the outputting voltage level of the PWM signal PMS.

Figure 2:
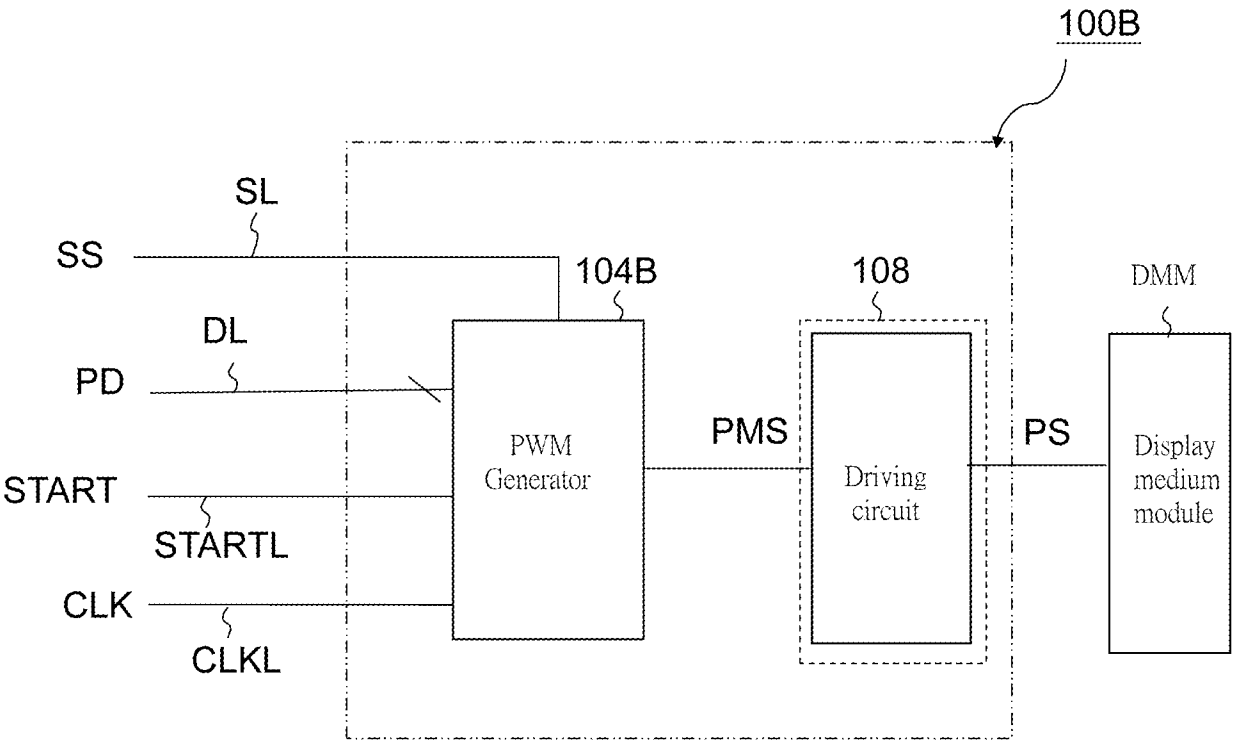
FIG. 2 is a diagram of a pixel circuit of another embodiment of the present invention.

FIG. 2 is a diagram of a pixel circuit 100B of another embodiment of the present invention. The pixel circuit 100B comprises: Pulse Width Modulation (PWM) generator 104B, wherein the PWM generator 104B contains: electrically coupled to a scan line SL for receiving a scanning signal SS, a plurality of data lines DL for receiving pixel data PD, a starting line STARTL for receiving the (PWM) generator starting signal START and electrically coupled to a clock line CLKL for receiving the clock signal CLK, and according to the scanning signal SS, the starting signal START, the clock signal CLK and the pixel data PD to generate a pulse width to adjust the PWM signal PMS, through precisely controlling the magnitude of voltage and/or current values to drive the display medium during a period of time for accurately rendering the grayscale of the display. Whenever, the PWM Generator 104B has sufficient driving capability to fully control the display status of the smaller pixel electrodes loading, then the pulse width modulation signal PMS generated by the PWM can be directly electrically coupled to the pixel display media module DMM (ref to FIGS. 7A and 7B). Wherein, the pixel circuit 100B further comprise: a driving circuit 108, wherein the driving circuit 108 electrically coupled to the PWM generator 104B and according to the PWM signal PMS in voltage and/or current mode to generate the pixel signal PS electrically coupled to the pixel electrode pixel of the display media module DMM (as previously shown in FIG. 1).

Figure 2A:
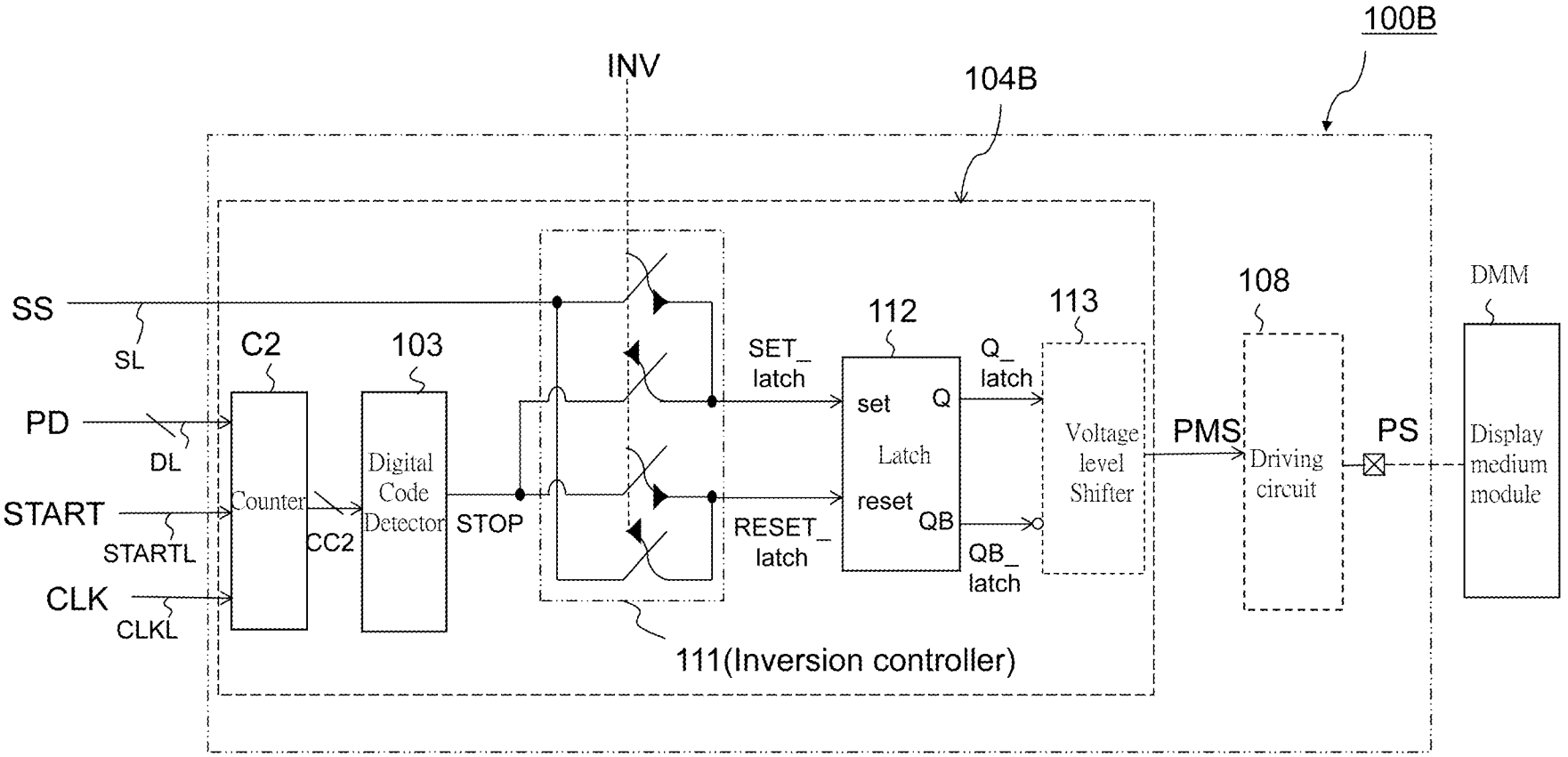
FIG. 2A is a detailed diagram of a pixel circuit of another embodiment of the present invention in FIG. 2.

FIG. 2A is a detailed diagram of a pixel circuit 100B of another embodiment of the present invention in FIG. 2. The PWM Generator 104B comprises: a counter C2, a digital code detector 103, an inversion controller 111, a latch 112 and a voltage level shifter 113. The Counter C2 comprises: a connected node electrically coupled to the clock signal line CLKL for receiving a clock signal CLK, a connected node electrically coupled to the starting signal line STARTL for receiving the starting signal START, another connected node electrically coupled to a plurality of the data lines DL for receiving pixel data PD and an output node for generating counter code CC2 according to the pixel data PD and clock signal CLK. The counter C2 can continuously increasing or decreasing count. For example, the counter code CC2 continues to increment, such as CC2_0 is "0000000000", CC2_1 is "0000000001" . . . CC2_256 is "0100000000" . . . CC2_512 is "1000000000" . . . , CC2_1023 is "1111111111", but not limited to this. The digital code detector 103 comprises a plurality of nodes electrically coupled to the counter code CC2 for receiving counter code detection, and the output node used to generate the PWM stop signal STOP according to the counter CC2. For example, the pixel data PD is 10 bits of data, the binary byte is "0100000000", expressed as 256 by decimal bytes, the binary byte of the pixel data PD is loaded into the counter, and then the counter code CC2 is counted down from 256 to 0. Whenever, the counter code CC2 is counted down to 0, the PWM stop signal STOP is generated in the digital code detector 103 at the output node. Wherein, the inversion controller 111 electrically coupled to the digital code detector 103 for receiving the PWM stop signal STOP as the second input node, thereof the other connection and operation mode has the same functions as the above-mentioned inversion controller 111. The connection and operation of the latch 112 and the voltage level shifter 113 are the same as above-mentioned in FIG. 1A, omitting the repeating illustrations.

Figure 3B:
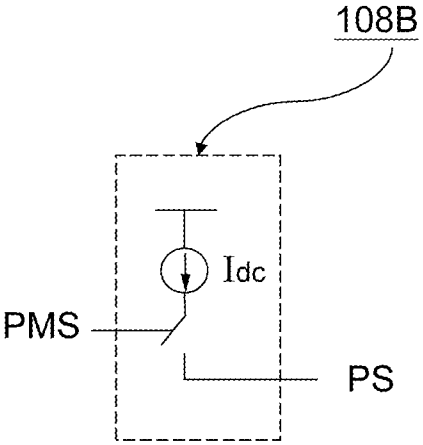
FIG. 3B is a current-driven diagram according to a pixel circuit of the present invention in FIG. 1 and FIG. 2.
Figure 3A:
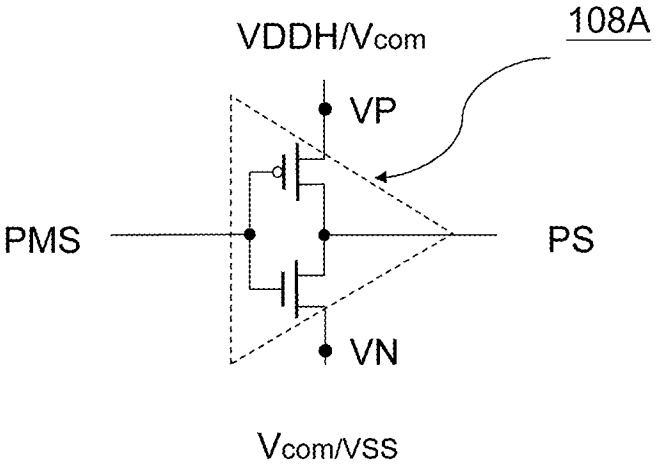
FIG. 3A is a voltage-driven diagram according to a pixel circuit of the present invention in FIG. 1 and FIG. 2.

FIG. 3A is a voltage-driven diagram according to a pixel circuit 100A and 100B of the embodiments of the present invention in FIG. 1 and FIG. 2. The driving circuit 108 comprises: a CMOS (Complementary Metal Oxide Semiconductor) inverter 108A for controlling the transmission of PWM signals and generating a pixel signal PS electrically coupled to the pixel electrode of the pixel display media module DMM, but it's not limited that. Further, it may comprise at least one of the N type or P type MOS (Metal Oxide Semiconductor) transistors and the other driving circuits of the combinations thereof.

The source node VP of the PMOS transistor of the CMOS inverter 108A is driven by a high supply voltage VDDH or a common voltage Vcom, and another source node VN of the NMOS transistor of the inverter is driven by a common voltage Vcom or a low voltage VSS. The common voltage Vcom can be the average of high supply voltage VDDH and low voltage VSS. For example, the high supply voltage VDDH can be 5V. The low voltage VSS can be 0V and the common voltage Vcom can be 2.5V.

FIG. 3B is a current-driven diagram according to a pixel circuit 100A and 100B of the embodiments of the present invention in FIG. 1 and FIG. 2. The driving circuit 108 comprises: voltage-current conversion driver 108B with current source/current sink source Idc and switch convert the PWM voltage signal to the current pixel signal PS electrically coupled to the pixel display media module DMM, but this is not limited to this. Further, it may comprise at least one of the N type or P type MOS (Metal Oxide Semiconductor) transistors and the drive circuits of the other driving circuit combinations thereof.

Figure 4A:
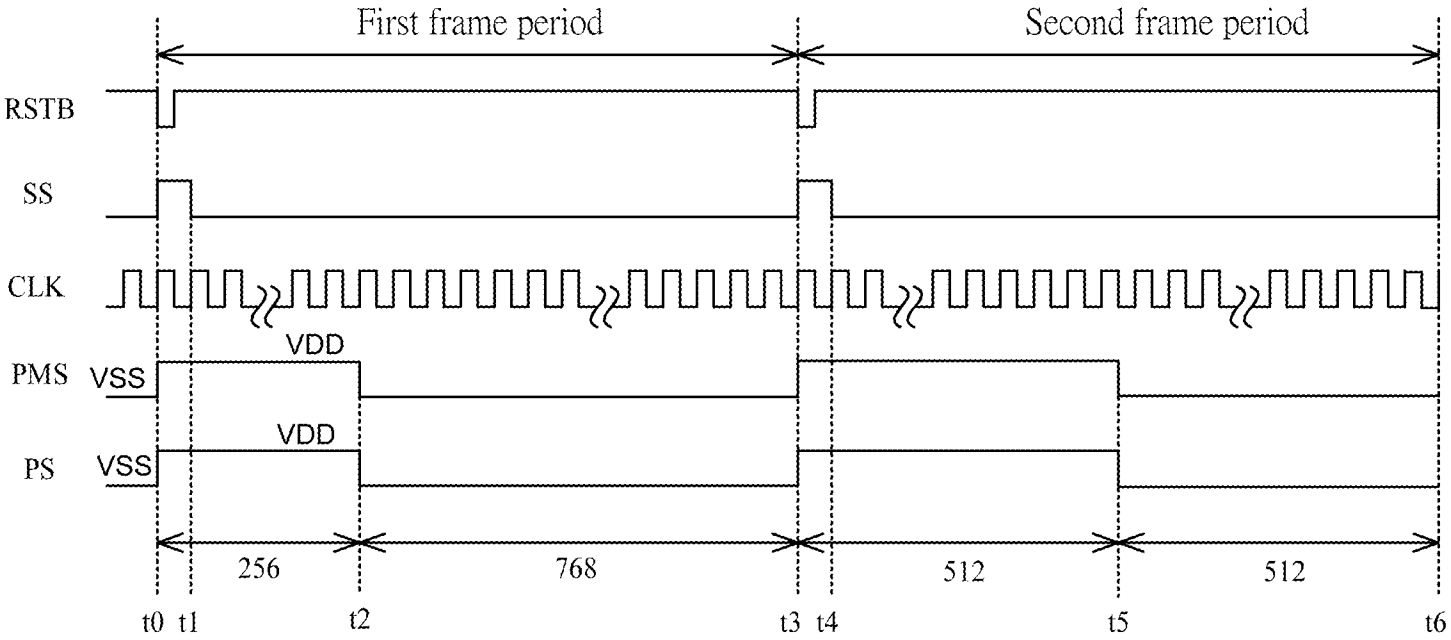
FIG. 4A is an operating waveform diagram according to a frame period of the pixel circuit of the present invention in FIG. 1.

FIG. 4A is an operating waveform diagram two frame periods of the pixel circuit 100A of FIG. 1 in the present invention. In this embodiment, the input pixel data PD is 10 bits data, for example, binary bits are "0100000000", represented in decimal bytes as 256. In the first frame period and the second frame period, the input pixel data PD is "0100000000" in decimal bytes represented as 256 and "1000000000" in decimal bytes represented as 512. At time t0, the counter C1 receives a low-pulse reset signal RSTB to reset the counter code CC1 and initiates the counting cycle of the first frame driving operation. The data latch 102 receives the pulse scanning signal SS during the period from t0 to t1 to collect the pixel data PD and sustains the pixel data until the instant of t3 until the next pulse scanning signal SS is received. The pulse scanning signal SS is also sent to the PWM generator 104A, on the time t0 initiating the PWM pulse signal PMS is pulled to the high voltage VDD, and the driving circuit 108 also drives the corresponding pixel signal PS to the high voltage VDD. The counter C1 can continuously increasing or decreasing count over the entire count cycle, for example, the counter code CC1 continues to increment, CC1_0 is "0000000000", CC1_1 is "0000000001" . . . CC1_256 is "0100000000" . . . CC1_512 is "1000000000" . . . , CC1_1023 is "1111111111". At time t2, when the counter code CC1 matches the pixel data PD (in the case of the first frame period is 256), the PWM generator 104A consummates the PWM pulse and pulls the PWM signal PMS from the high voltage VDD to the low voltage VSS. The low voltage VSS is sent to the driving circuit 108, and then the driving circuit 108 outputs the pixel signal PS in voltage mode or voltage-to-current mode, driving the corresponding display pixels to the low voltage VSS. As shown in FIG. 4A, the width of the PWM pulse is the time period from t0 to t2. At time t3, the counter C1 receives another low pulse reset signal RSTB to reset the counter C1 and start another count cycle for another frame cycle. The data latch 102 receives the new next pixel data PD from t3 to t4, and latches the next pixel data until the instant of t6 until the next pulse scan signal SS is received. the data Latch 102 sends the next new pixel data PD to PWM Generator 104A. the pulse scan signal SS is also sent to PWM generator 104A, at time t3 initiates PWM pulse signal PMS pull to high voltage VDD, the driving circuit 108 will also drive the corresponding display pixel signal PS to high voltage VDD. The counter code CC1 continues to increment as described above throughout the count cycle. At time t5, when the counter code CC1 matches the pixel data PD (in the case of the second frame period is 512), the PWM generator 104A consummates the PWM pulse and pulls the PWM signal PMS from the high voltage VDD to the low voltage VSS. The low voltage VSS is sent to the driving circuit 108, and then the driving circuit 108 outputs the pixel signal PS in voltage mode or voltage-to-current mode, driving the corresponding display pixels to the low voltage VSS. As shown in FIG. 4A, the width of the PWM pulse is from t3 to t5. At time t6, counter C1 receives another low pulse reset signal RSTB to reset counter C1 and start another count cycle for another frame cycle. This operation repeats the frame cycle count as described previously.

In the embodiment of the 4A diagram, the whole pulse frame period cycle of the PWM signal PMS is from time t0 to time t3, and then from time t3 to time t6, each whole pulse frame cycle is 1024 units. The example of the first frame period PWM pulse width is from time t0 to time t2, the pulse width of the example is 256 units, the second frame period is from time t3 to time t5, the pulse width of the example is 512 units. In this embodiment, one unit represents a clock period in the clock signal CLK, so 1024 units can be 1024 clock periods. Each clock width can be converted to a pixel grayscale or a plurality of clock widths converted to a pixel grayscale, but it is not limited that. The clock width of 256 units can be presented as a relatively dark grayscale pixel (lower pixel brightness), and the clock width of 768 units is presented as a relatively bright grayscale pixel (higher pixel brightness) and vice versa.

Figure 4B:
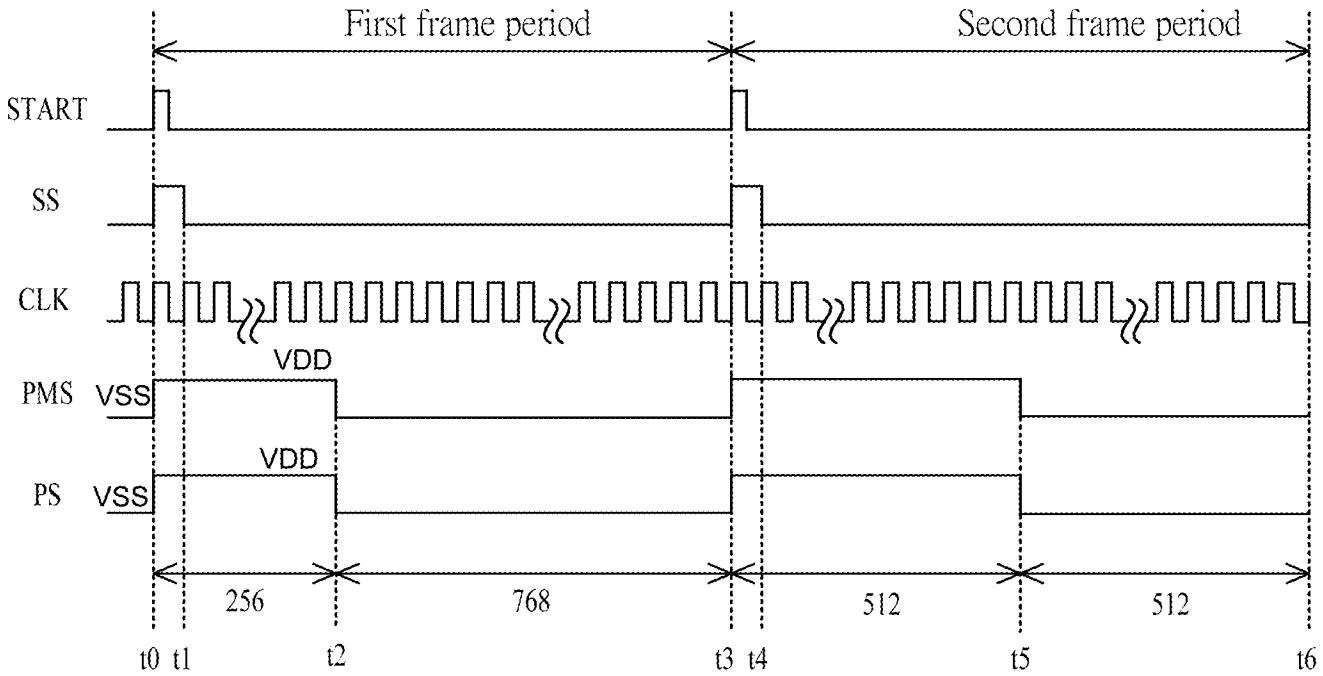
FIG. 4B is an operating waveform diagram according to a frame period of the pixel circuit of the present invention in FIG. 2.

FIG. 4B is an operating waveform diagram two frame periods of the pixel circuit 100B of FIG. 2 in the present invention. During the first frame period and the second frame period, the input pixel data PD is "0100000000" and "1000000000" respectively. At time t0, the PWM generator 104B receives the start signal START to initiate the PWM pulse signal PMS and counts the frame period of the first frame cycle operation. The driving circuit 108 pulls the corresponding display pixel drive to the high voltage VDD. During the t0 to t1 period, the PWM generator 104B receives the scan signal SS and then loads the pixel data PD to determine the width of the PWM pulse. At time t2, when the clock cycle is counted by the PWM generator 104B and matches the pixel data PD (in the case of the first frame period is 256), the PWM Generator 104B ends the PWM pulse and pulls the PWM signal PMS from the high voltage VDD to the low voltage VSS. The low voltage VSS is transmit to the driving circuit 108, and then the driving circuit 108 outputs the pixel signal PS in voltage mode or voltage-to-current mode, driving the corresponding display pixels to the low voltage VSS. As shown in FIG. 4B, the PWM pulse width and the pixel signal PS width are from t0 to t2 of period time. At time t3, PWM Generator 104B receives another start signal STAT to start the PWM pulse signal PMS and starts creating another PWM signal for another frame operation. The following scenario is similar to the first frame period PWM aforementioned. The PWM Generator 104B receives new pixel data PDs during the period of time from t3 to t4. The PWM generator 104B initiates the PWM pulse at time t3, and the driving circuit 108 drives the corresponding display to the high voltage VDD. At time t5, when the clock cycle is counted by the PWM generator 104B and matches the pixel data PD (in the case of the first frame period is 512), The PWM Generator 104B ends the PWM pulse and pulls the PWM signal PMS from the high voltage VDD to the low voltage VSS. The low voltage VSS is transmit to the driving circuit 108, and then the driving circuit 108 outputs the pixel signal PS in voltage mode or voltage-to-current mode, driving the corresponding display pixels to the low voltage VSS. As shown in FIG. 4B, the PWM pulse width and the pixel signal PS width are from t3 to t5. At time t6, the PWM Generator 104B receives another start signal STAT to start the PWM pulse signal PMS and start producing another PWM cycle, which is repeated cycle counting as described aforementioned.

Figure 5:
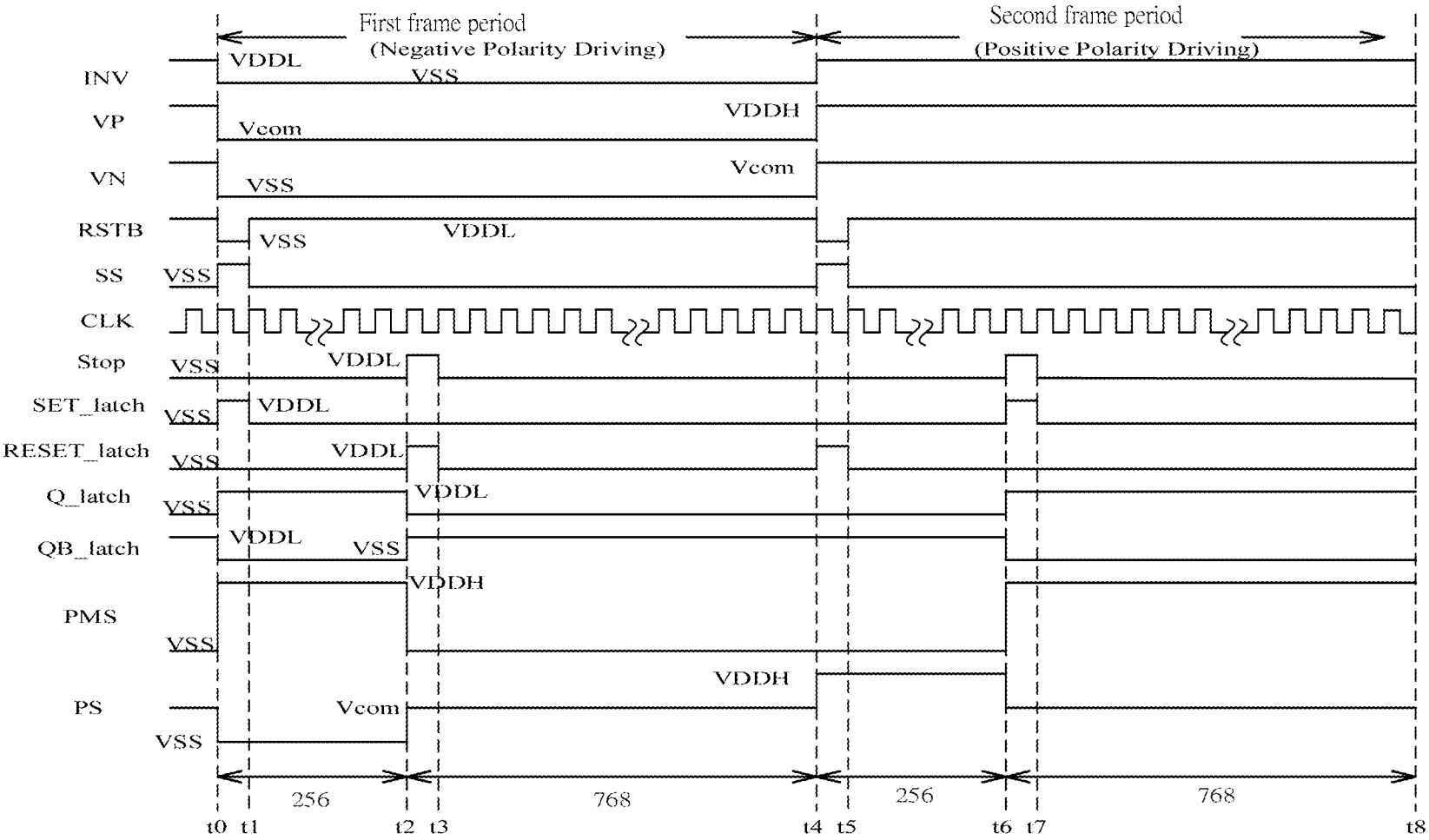
FIG. 5 is an operating waveform diagram according to a reverse operation of the pixel circuit of the present invention in FIG. 1A.

FIG. 5 is an operating waveform diagram two frame periods of the pixel circuit 100A of FIG. 1 of another embodiment in the present invention. During the first frame period from t0 to t4, the inversion signal INV is low voltage and the pixel circuit 100A performs a negative polarity driving operation; during the second frame period from t5 to t8, the inversion signal INV is high and the pixel circuit 100A performs a positive polarity driving operation. During the negative polarity drive operation, the source node VP of the PMOS transistor of the driving circuit 108 is driven by a common voltage Vcom, and another source node VN of the NMOS transistor of the driving circuit 108 is driven by a low voltage VSS; and during the positive polarity drive operation, the source node VP of the PMOS transistor of the driving circuit 108 is driven by the high supply voltage VDDH, and the source node VN of the NMOS transistor of the driving circuit 108 is driven by the common voltage Vcom. In this embodiment, the input pixel data PD is 10 bits of data, for example, "0100000000" is binary and decimal is 256. At time t0, the counter C1 receives a low-pulse reset signal RSTB to reset the counter code CC1 and initiates the counting cycle of the first frame driving operation. During the time period from t0 to t1, the pulse scanning signal SS is transmitted to the data latch 102. While the inversion signal INL is VSS, during the time period from to to t1, the pulse scanning signal SS is also transmitted to the set latch node Set_Latch of latch 112 by the inversion controller 111. The latch 112 outputs the low supply voltage VDDL at output node Q and the low voltage VSS at the output node QB. The non-inverting input node and inverting input node of voltage level shifter 113 respectively receive low supply voltage VDDL and low voltage signal VSS. The voltage level shifter 113 boosts the output signal PMS from low voltage VSS to high supply voltage VDDH. Because the driving circuit 108 outputs the pixel signal PS according to the PWM signal PMS, then the pixel signal PS is pulled from the common voltage Vcom to the low voltage VSS at the time t0 for negative polarity driving. The data latch 102 receives the pixel data PD during the period from t0 to t1, and latches the pixel data until the next pulse scan signal SS is received at the t4 instant. Meantime, the data latch 102 transmits the pixel data PD to the data comparator 110.

At time t2, when the counter code CC1 matches the pixel data PD (in the case of the first frame period is 256), the data comparator 110 outputs the width signal STOP pulse during time t2 and t3. As shown in FIG. 5, the data comparator 110 pulls the signal STOP of comparator from low voltage VSS to low supply voltage VDDL at time t2, and the signal STOP of comparator from low supply voltage VDDL to low voltage VSS at time t3. The comparator signal STOP pulse is transmitted to the reset node of the latch 112. The latch 112 resets output node Q to low voltage VSS and pulls output node QB up to low supply voltage VDDL. The non-inverting input node and inverting input node of voltage level shifter 113 receive low voltage VSS and low supply voltage VDDL, respectively. The voltage level shifter 113 pulls the output signal PMS from the high supply voltage VDDH to the low voltage VSS. The driving circuit 108 pulls the output signal PS from the low voltage VSS to the common voltage Vcom at time t2 for negative polarity driving. The time period from t0 to t2 is the PWM width time of the negative polarity driving operation, the drive voltage PS is low voltage VSS during this time.

At time t4, counter C1 receives another low pulse reset signal RSTB to reset counter C1 and starts to be adapted another frame cycle driving operation. During the time period from t4 to t5, the pulse scan signal SS is transmitted to the data latch 102. While the inverting signal INL is VDDL, the pulse scan signal SS is also transmitted to the reset node of latch 112 through inversion controller 111 during the time period from t4 to t5. The latch 112 outputs a low signal VSS at output node Q and a low supply voltage VDDL at the output node QB. Since the non-inverting input nodes and inverting input nodes of the voltage level shifter 113 respectively receive low voltage VSS and low supply voltage VDDL, the voltage level device 113 maintains the output signal PMS at a low voltage VSS. The PMOS transistor of the driving circuit 108 is still conducting, but the source node VP of the PMOS transistor is driven by a high supply voltage VDDH. Therefore, the pixel signal PS will be pulled up at time t4 to the high supply voltage VDDH for positive polarity driving operation. The data latch 102 receives the pixel data PD during the period from t4 to t5, and the latching pixel data PD until the next pulse scan signal SS is received. The data latch 102 sends the pixel data PD to the data comparator 110. At time t6, while the counter code CC1 matches the pixel data PD (in the case of the second frame period is 256), the data comparator 110 outputs the comparator signal STOP pulse between t6 and t7. As shown in FIG. 5, the data comparator 110 pulls the comparator signal STOP from low voltage VSS to low supply voltage VDDL at time t6 and pulls the comparator signal STOP from low supply voltage VDDL to low voltage VSS at time t7. The comparator signal STOP pulse is transmitted to the setup node of latch 112. The latch 112 sets output node Q to low supply voltage VDDL and pulls output node QB down to voltage VSS. The non-inverted input nodes and inverted input nodes of voltage level shifter 113 respectively receive low supply voltage VDDL and low voltage VSS. The voltage level shifter 113 pulls the output signal PMS from the low voltage VSS to the high supply voltage VDDH. At time t6 the driving circuit 108 pulls the output signal PS from the high supply voltage VDDH to the common voltage Vcom for positive polarity driving. The time period between t4 and t6 is the PWM time used for positive polarity driving operations, during this period, the drive voltage PS is the high supply voltage VDDH. The following cycle is similar to the previous counting period. At time t8, counter C1 receives another low pulse reset signal RSTB to reset counter C1 and start another counting cycle. Duplicating the operation as described previously.

In the embodiment of FIG. 5, the pulse frame period of pixel signal PS is from time t0 to time t4, and then from time t4 to time t8, each pulse frame period is 1024 units. The pulse width is from time t0 to time t2 and from time t4 to time t6, each pulse width is 256 units. In this embodiment, one unit represents a clock period in the clock signal CLK, so 1024 units can be 1024 clock periods. Each clock width can be converted to a pixel grayscale or a plurality of clock widths converted to a pixel grayscale, but it is not limited that. Although the pixel data for the two count cycles is the same in this embodiment, in some other embodiments, the pixel data can be different for different counting cycles. For example, the clock width of 256 units can be presented as a relatively dark grayscale pixel (lower pixel brightness) during the first frame cycle, the clock width of 768 units is presented as a relatively bright grayscale pixel (higher pixel brightness) during the second frame cycle, and vice versa.

Figure 6:
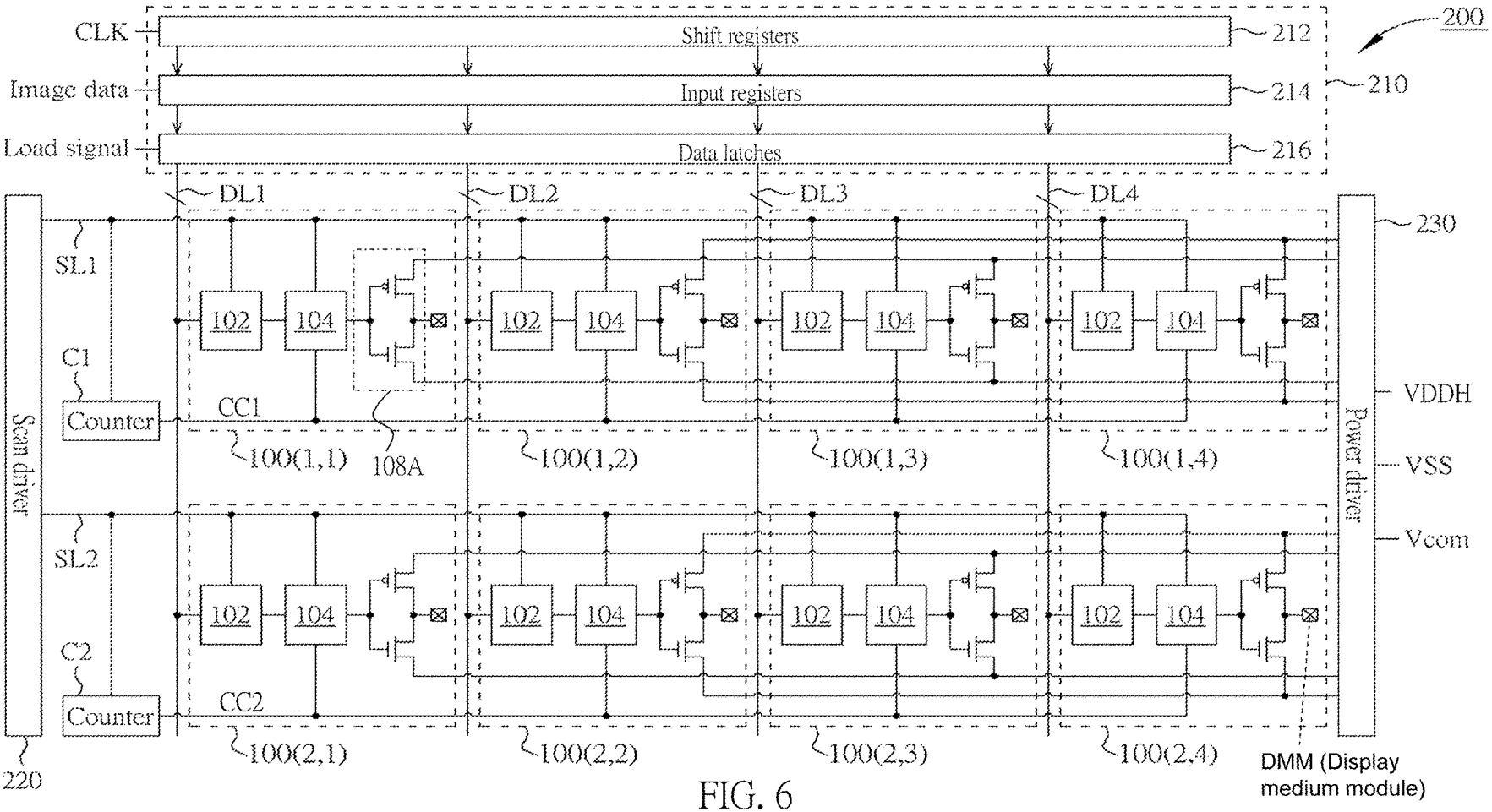
FIG. 6 is a diagram of an exemplary display device of an embodiment of the present invention.

FIG. 6 is a diagram of an exemplary display device 200 of the pixel circuit 100A of the FIG. 1 and the second pixel circuit 100B of the FIG. 2 in the present invention. The display device 200 comprises a plurality of data lines DL1 to DL4, a plurality of scan lines SL1 to SL2, scan driver 220, source driver 210, power driver 230, a plurality of pixel circuits 100 (1,1) to 100 (2,4) and a plurality of counters C1 to C2. The source driver 210 is electrically coupled to the plurality of data lines DL1 to DL4 and is set to output pixel data PD to the plurality of data lines DL1 to DL4. The scan driver 220 is electrically coupled to the plurality of scan lines SL1 to SL2 and is set to output scan signal SS to the plurality of scan lines SL1 to SL2. The plurality of counters C1 to C2 are set to produce the plurality of counter codes CC1 and CC2. Each pixel circuit 100 controls the brightness of a pixel unit on the display device 200.

The power driver 230 is electrically coupled to the plurality pixel circuits 100 (1,1) to 100 (2,4) of the driving circuit 108. The power driver 230 provides high supply voltage VDDH, common voltage Vcom and low voltage VSS to drive circuits the plurality of pixel circuits from 100 (1,1) to 100 (2,4). The source driver 210 comprises: a plurality of shift registers 212 shifted by the clock signal CLK; a plurality of input registers 214 electrically coupled to the shift register 212, and according to the clock signal CLK to receive image data and a plurality of data latches 216 electrically coupled to the input register 214, and according to the loading signal latch the image data received from the input register 214.

Figure 7A:
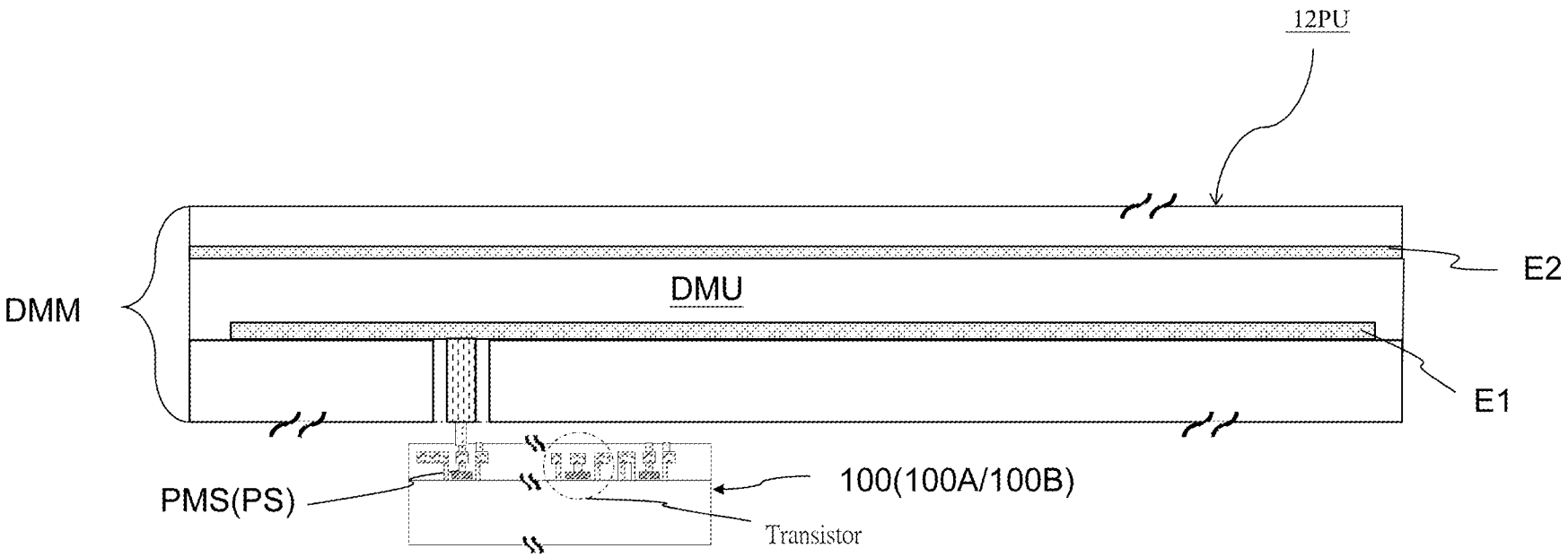
FIG. 7A is a cross-section diagram of the pixel unit according to the display device of the embodiment of the present invention in FIG. 6.

FIG. 7A is a cross-section diagram of the pixel unit 12PU according to the display device 200 of the embodiment of the present invention in FIG. 6. The pixel unit 12PU comprises: a display media module DMM and a pixel circuit 100. The pixel circuit 100 of the pixel unit is pre-manufactured, then assembled to the display media module DMM of the pixel unit 12PU for completing the pixel unit 12PU. In other words, the pixel circuit 100 is not being directly manufactured on a part of the display media module DMM, instead of the pixel circuit 100 is manufactured independently on another substrate; Therefore, the manufacturing process condition of the pixel circuit 100 is not limited by the substrate characteristics of the display media module DMM (e.g., the heat resistance properties of the substrate material). The substrate of the pixel circuit 100 is allowed more flexible integration of the other functional components transistors: for example, touch sensing function elements, image capture function elements, memory function elements, control function elements, wireless communication function elements, self-luminous function elements, passive components (inductors, resistors, capacitors or combination thereof), photovoltaic functional elements and any combination of thereof (but not limited to this) on the pixel circuit 100 substrate. Furthermore, the transistor characteristics of the pixel circuit 100 can be optimized for improving the uniformity, functionality, lower manufacturing costs and production time, etc., to achieve a high-performance display device by the semiconductor manufacturing processes. The display media module DMM comprises: the first electrode E1, the second electrode E2 and the display medium DMU, which are controlled using voltage or current modulation by the pixel circuit 100 (only shown a pair of electrodes and a display medium in FIG. 7A, not only limited as this, a plurality of pairs of electrode and display media also can be employed). The first electrode E1 and the second electrode E2 are separated from each other, and the display medium DMU is disposed between the first electrode E1 (pixel electrode) and the second electrode E2 (common electrode or reference electrode). The pixel signal PMS can select directly electrically coupled to the first electrode E1 (pixel electrode) of the smaller loading through the output node of the pulse width modulation (PWM) generator 104A or 104B, or through the pixel signal output node PS of the driving circuit 108 electrically coupled to the first electrode E1 of the display media module DMM using the voltage or current driving mode.

Figure 7B:
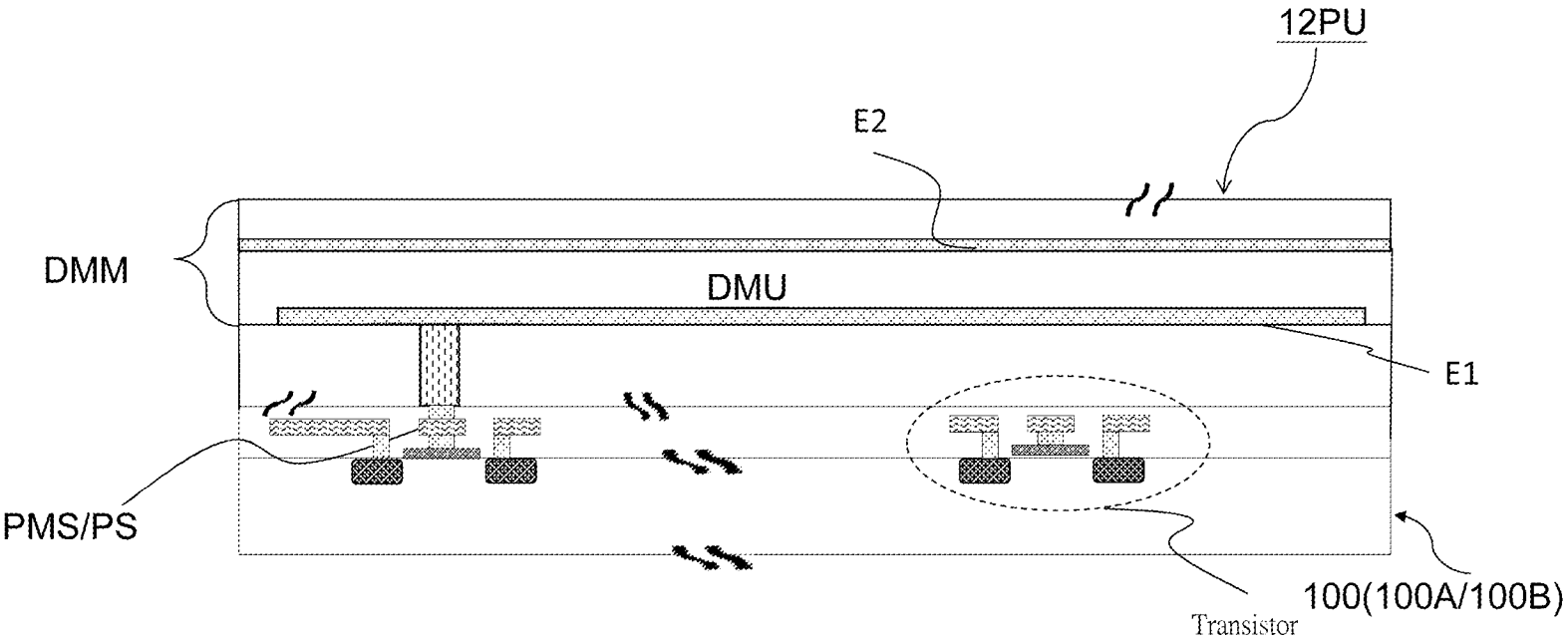
FIG. 7B is another cross-section diagram of the pixel unit according to the display device of the embodiment of the present invention in FIG. 6.

FIG. 7B is a cross-section diagram of another pixel unit 12PU according to the display device 200 of the embodiment of the present invention in FIG. 6. The pixel unit 12PU comprises: a display media module DMM and a pixel circuit 100. The display media module DMM of the pixel unit 12PU is sequentially manufactured directly on the same substrate of the pixel circuit 100 in accordance with the manufacturing steps, compared with the FIG. 7A diagram, the pixel unit 12PU belongs to be integrated manufacturing. In other words, all the composite materials of the display media module DMM directly on the pixel circuit 100 substrate successively according to the manufacturing steps to complete continuous manufacturing. The substrate of the pixel circuit 100 is allowed more flexible integration of the other functional components transistors: for example, touch sensing function elements, image capture function elements, memory function elements, control function elements, wireless communication function elements, self-luminous function elements, passive components (inductors, resistors, capacitors or combination thereof), photovoltaic functional elements and any combination of thereof (but not limited to this) on the pixel circuit 100 substrate. Furthermore, the transistor characteristics of the pixel circuit 100 can be optimized for improving the uniformity, functionality, lower manufacturing costs and production time, etc., to achieve a high-performance display device. The display media module DMM comprises: the first electrode E1, the second electrode E2 and the display medium DMU, which are controlled using voltage or current modulation by the pixel circuit 100 (only shown a pair of electrodes and a display medium in FIG. 7A, not only limited as this, a plurality of pairs of electrode and display media also can be employed). The first electrode E1 and the second electrode E2 are separated from each other, and the display medium DMU is disposed between the first electrode E1 (pixel electrode) and the second electrode E2 (common electrode or reference electrode). The pixel signal PMS can select directly electrically coupled to the first electrode E1 (pixel electrode) of the smaller loading through the output node of the pulse width modulation (PWM) generator 104A or 104B, or through the pixel signal output node PS of the driving circuit 108 electrically coupled to the first electrode E1 of the display media module DMM using the voltage or current driving mode (refer to FIG. 7A/7B).

The display media DMU of FIG. 7A and FIG. 7B comprises self-luminous medium materials, non-self-luminous materials, filter materials, conductive materials, insulation materials, light absorption materials, light-reflecting materials, light-refractive materials, polarizing materials, light diffuse materials and at least one of the foregoing materials. Wherein, the Non-self-luminous medium materials may include at least one of electrophoretic material, electric fluid material, liquid crystal material, micro electromechanical reflective material, electrowetting material, electric ink material, magnetic fluid material, electrochromic material and thermochromic material. The self-luminous medium materials may include at least one of electroluminescent material, photoluminescent material, cathodoluminescent material, field emissive luminescent material, phosphorescent materials, fluorescent materials and light-emitting diode materials in at least one material, used to produce white, green, blue, orange, indigo, purple and yellow or its combination.

Figure 8:
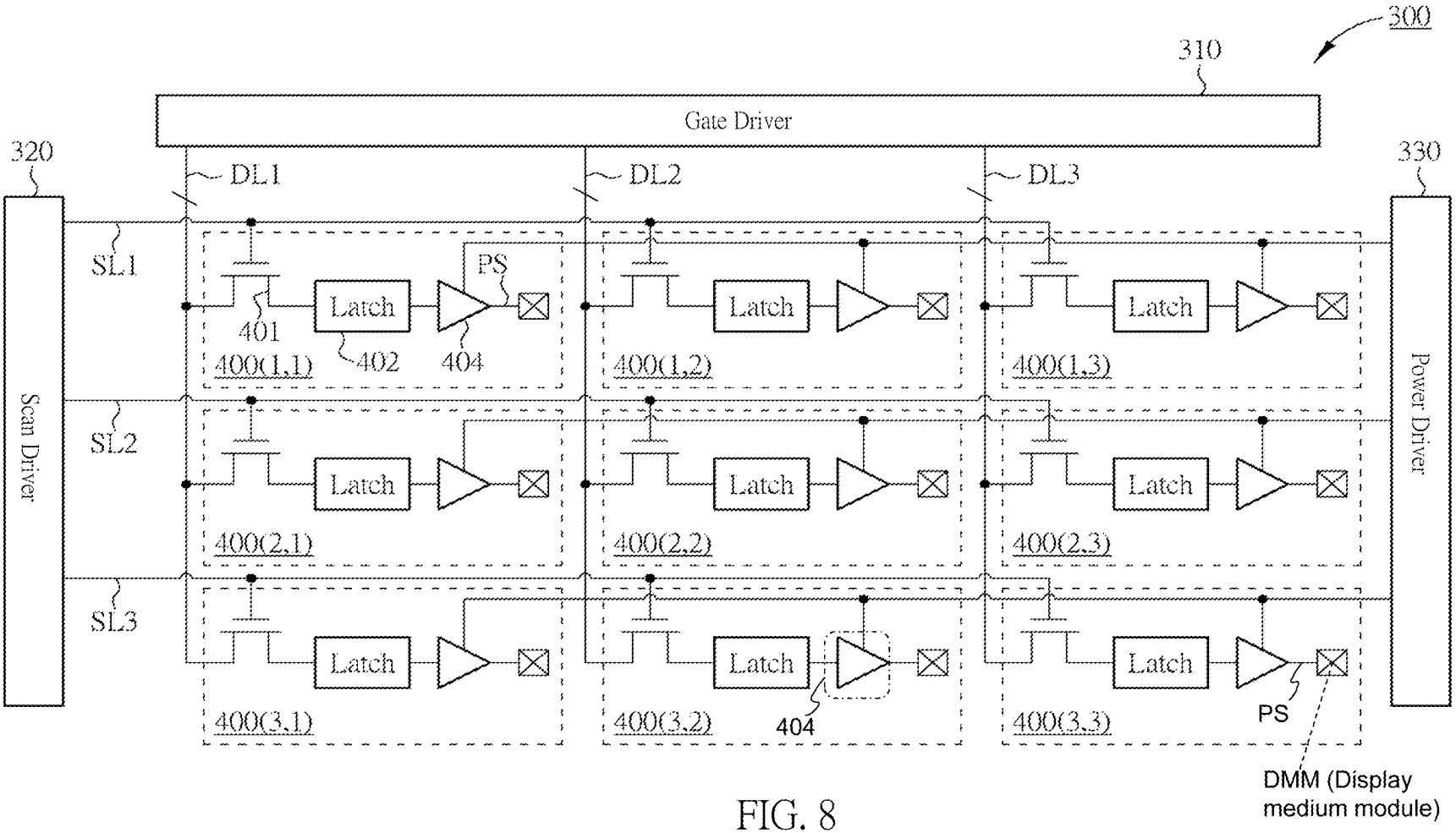
FIG. 8 is a diagram of an exemplary display device of another embodiment of the present invention.

FIG. 8 is a diagram of an exemplary display device 300 of another embodiment of the present invention. The display device 300 comprises: a plurality of data lines DL1 to DL3, a source driver 310 electrically coupled to the data lines from DL1 to DL3 to output pixel data PD to the data lines from DL1 to DL3, a plurality of scan lines from SL1 to SL 3, a scan driver 320 is electrically coupled to the scan lines from SL1 to SL3 and output the scan signal SS to scan line SL1 to SL3 with a plurality of pixel circuits 400 (1,1) to 400 (3,3). Each pixel circuit from 400 (1,1) to 400 (3,3) comprises: transistor 401, which is electrically coupled to the corresponding data line DL for receiving the pixel data PD and the corresponding scanning line SL for receiving the scanning signal SS, and latch 402 (which may be a basic capacitor, NAND logic gate, NOR logic gate, register, memory or any other digital circuit one of its combinations or a combination thereof (but not limited to this)) electrically coupled to the transistor 401 for receiving and latching pixel data PD. The pixel circuit 400 (1,1) to 400 (3,3) can comprise a driving circuit 404 electrically coupled to the data latch 402, which generate pixel signal PS according to the pixel data PD. In this embodiment, the driving circuit 404 may be at least one of the CMOS (complementary metal oxide semiconductors), N-type and/or P-type MOS (metal oxide semiconductors) transistor and a combination thereof. The display device 300 further comprises a power driver 330, which is electrically coupled to the driving circuit 404 of the pixel circuit 400 (1,1) to 400 (3,3), for providing the high supply voltage VDDH, common voltage Vcom and low voltage VSS to the driving circuit 404. The common voltage Vcom can be the average of high supply voltage VDDH and low voltage VSS.

Figure 9A:
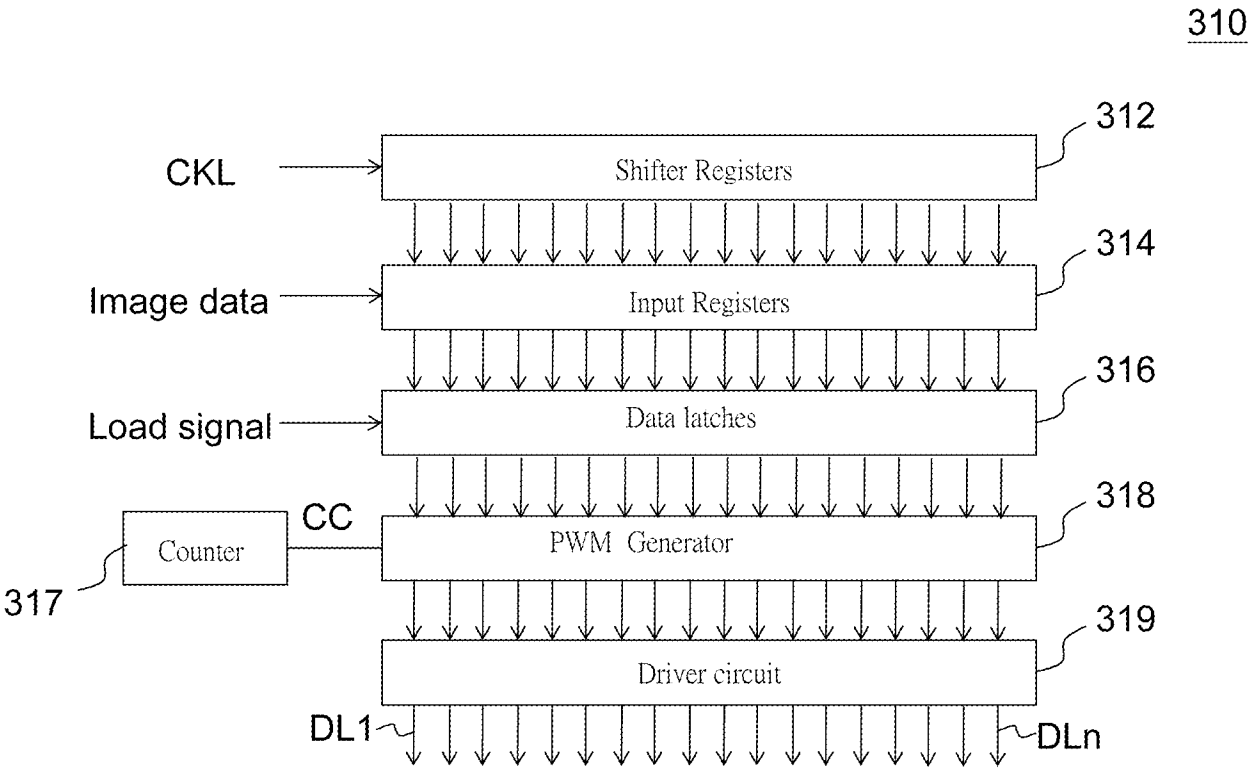
FIG. 9A is a diagram showing source driver according to the display device of the embodiment of the present invention in FIG. 8.

FIG. 9A is a diagram of the source driver 310 in FIG. 8 of the present invention. The source driver 310 comprises: a plurality of shift registers 312, a plurality of input registers 314, a plurality of data latches 316, a counter 317, a plurality of pulse width modulation (PWM) generator 318 and a plurality of driving circuits 319 (optional). The Shift register 312 is used to receive the shift clock signal CLK. The input register 314 is electrically coupled to the shift register 312 and receives the image data according to the clock signal CLK. The data latch 316 is electrically coupled to the input register 314 and latches the image data from the input register 314 according to the loading signal. The counter 317 generates counter code CC. The PWM generator 318 is electrically coupled to the data latch 316 and counter 317, according to the image data and counter code CC for generating the PWM signal. The driving circuit 319 is electrically coupled to the PWM generator 318 and the data lines DL1 to DL3 (shown in FIG. 8), and the pixel data PD are generated according to the PWM signal. If the source driver 310 does not comprise a plurality of the driving circuit 319, the PWM generator 318 will directly generate pixel data PD according to the image data and counter code CC. Similarly, the pixel circuit 100 of FIG. 7A, the pixel circuit 400 (1,1) to 400 (3,3) can also output the pixel signal PS to the first electrode E1 of the display medium module DMM of the FIG. 7A. The pixel circuit 400 (1,1) to 400 (3,3) can drive the pixel unit 12PU according to a similar operating waveform from FIG. 4A to FIG. 5.

Figure 9B:
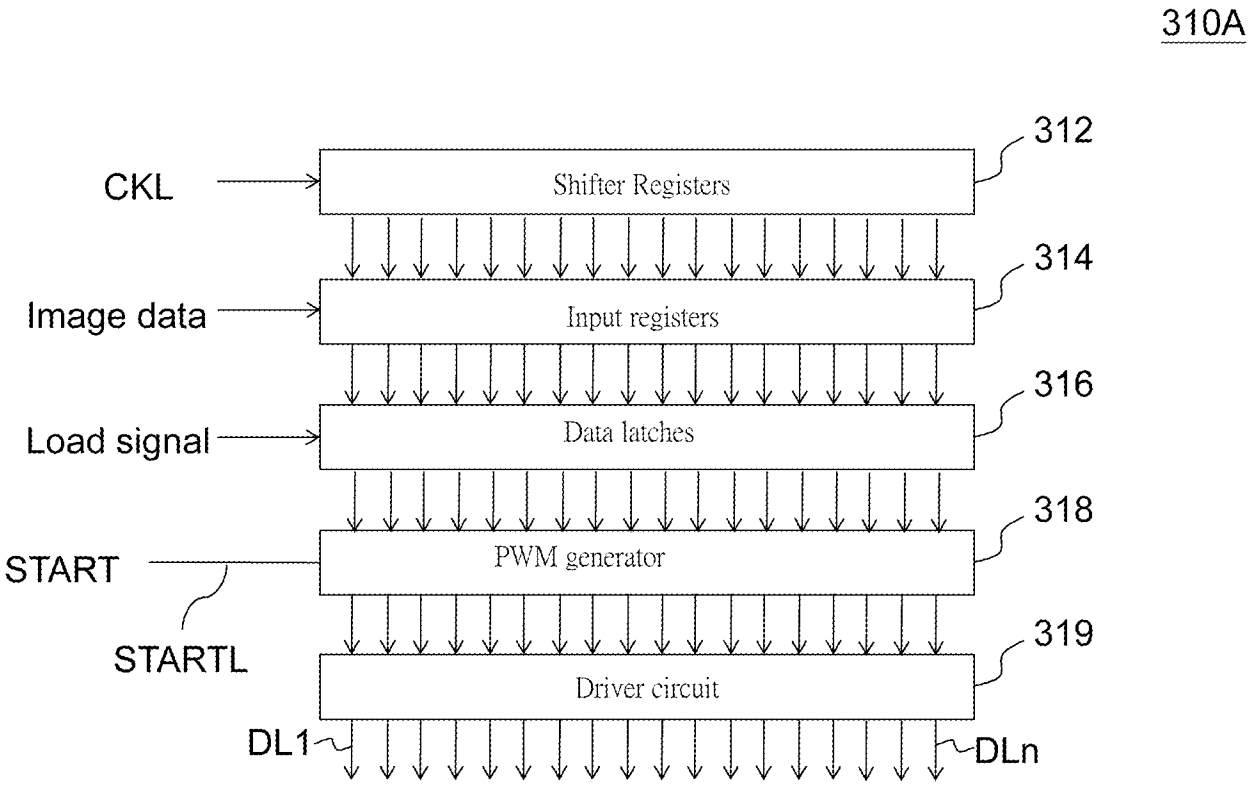
FIG. 9B is a diagram showing source driver according to the display device of another embodiment of the present invention in FIG. 8.

FIG. 9B is a diagram of another source driver 310A according to another embodiment of the present invention. The source driver 310 in FIG. 8 could be implemented by the source driver 310A in FIG. 9. The source driver 310 comprises: a plurality of shift registers 312, a plurality of input registers 314, a plurality of data latches 316, a plurality of pulse width modulation (PWM) generator 318 comprises: counters, digital code detectors, and START signal lines for receiving starting signals; counters can be increasing or decreasing counters, counter code CC will be increased if counter is increasing counter, and digital code detectors include a plurality of nodes electrically coupled to counter code CC for code detection, and the out node according to the counter CC to generate PWM stop signal STOP (as shown in FIG. 2A) and a plurality of driving circuit 319 (optional). The Shift register 312 is used to receive the shift clock signal CLK. The input register 314 is electrically coupled to the shift register 312 and receives the image data according to the clock signal CLK. The data latch 316 is electrically coupled to the input register 314 and latch the image data from the input register 314 according to the loading signal. The PWM generator 318 is electrically coupled to the data latch 316, according to the image data and the starting signal STATL of the (PWM) generator for generating the PWM signal. The driving circuit 319 is electrically coupled to the PWM generator 318 and the data lines DL1 to DL3 (shown in FIG. 8), and the pixel data PD generated according to the PWM signal. If the source driver 310 does not comprise a plurality of the driving circuit 319, the PWM generator 318 will directly generate pixel data PD according to the image data and counter code CC. Similarly, the pixel circuit 100 of FIG. 7A, the pixel circuit 400 (1,1) to 400 (3,3) can also output the pixel signal PS to the first electrode E1 of the display medium module DMM of the FIG. 7A. The pixel circuit 400 (1,1) to 400 (3,3) can drive the pixel unit 12PU according to a similar operating waveform from FIG. 4A to FIG. 5.

In summary, the embodiments provide a new type of pixel circuits and display devices. By employing the operation and control of mostly digital electronic elements and digital signals, the accuracy of gray scale and brightness control of display devices greatly improved.

The above illustrates the technical content of the pixel circuit and the display device according to each embodiment of the present invention, and the above content is not used to limit the scope of protection of the present invention. Those skilled in the art will readily observe that numerous modifications and alterations of the device and method may be made while retaining the teachings of the invention. Accordingly, the above disclosure should be construed as limited only by the metes and bounds of the appended claims.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A pixel unit comprising:

a pixel circuit, comprising:

a substrate;

a data latch coupled to a data line for receiving a pixel datum and a scan line for receiving a scan signal; and a pulse width modulation (PWM) generator coupled to the data latch, the scan line and a counter and configured to receive the scan signal directly from the scan line and generate a pulse width modulation (PWM) signal according to the pixel datum, the scan signal received directly from the scan line, and a counter code generated by the counter; and a display medium module disposed on the substrate of the pixel circuit, driven based on the PWM signal, and comprising a first electrode, a second electrode and a display medium;

wherein the first electrode and the second electrode are separated from each other, and the display medium is disposed between the first electrode and the second electrode; and wherein the PWM signal is outputted to the first electrode.

2. The pixel unit of claim 1, wherein the display medium comprises at least one of self-luminous medium material, non-self-luminous medium material, light-filtering material, electric conductive material, insulating material, light absorbing material, light reflecting material, photorefractive material, light deflecting material, light polarizing material and light diffusing material.

3. The pixel unit of claim 1, wherein the pixel circuit further comprises a driving circuit coupled to the PWM generator and configured to generate a pixel signal according to the PWM signal.

4. The pixel unit of claim 3, wherein the driving circuit is a CMOS (complementary metal oxide semiconductor) inverter.

5. The pixel unit of claim 3, wherein the pixel signal is outputted to the first electrode through the driving circuit.

6. The pixel unit of claim 5, wherein the display medium comprises at least one of self-luminous medium material, non-self-luminous medium material, light-filtering material, electric conductive material, insulating material, light absorbing material, light reflecting material, photorefractive material, light deflecting material, light polarizing material and light diffusing material.

7. A display device comprising:

a plurality of data lines;

a source driver coupled to the plurality of data lines and configured to output pixel data to the plurality of data lines;

a plurality of scan lines;

a scan driver coupled to the plurality of scan lines and configured to output scan signals to the plurality of scan lines;

a plurality of counters configured to generate a plurality of counter codes; and a plurality of pixel units each being the pixel unit of claim 1.

8. The display device of claim 7 further comprising a power driver coupled to driving circuits of the plurality of pixel circuits, and configured to supply a high voltage, a common voltage and a low voltage to the driving circuits of the plurality of pixel circuits;

wherein the common voltage is an average of the high voltage and the low voltage.

9. The display device of claim 7, wherein the source driver comprises:

a plurality of shift registers configured to shift a clock signal;

a plurality of input registers coupled to the shift registers, and configured to receive image data according to the clock signal; and a plurality of data latches coupled to the input registers, and configured to latch the image data received from the input registers according to a load signal.

10. The display device of claim 7, wherein the PWM generator comprises:

a data comparator comprising:

a first input node coupled to the data latch;

a second input node coupled to the counter; and an output node; and a latch comprising:

a set node coupled to the scan line;

a reset node coupled to the output node of the data comparator; and an output node coupled to an input node of the driving circuit;

wherein the power driver is further coupled to the data latch, the data comparator, and the latch, and configured to supply the high voltage and the low voltage to the data latch, the data comparator, and the latch.

11. A display device comprising:

a plurality of data lines;

a source driver coupled to the plurality of data lines and configured to output pixel data to the plurality of data lines;

a plurality of scan lines;

a scan driver coupled to the plurality of scan lines and configured to output scan signals to the plurality of scan lines; and a plurality of pixel units, each pixel unit comprising:

a pixel circuit comprising:

a substrate;

a data latch coupled to a corresponding data line for receiving a pixel datum and a corresponding scan line for receiving a scan signal; and a pulse width modulation (PWM) generator coupled to the data latch and configured to receive the scan signal directly from the scan line and generate a pulse width modulation (PWM) signal according to the pixel datum and the scan signal, which is received directly from the scan line; and a display medium module disposed on the substrate of the pixel circuit, driven based on the PWM signal, and comprising a first electrode, a second electrode and a display medium.

12. The display device of claim 11, wherein the pixel circuit further comprises a driving circuit coupled to the data latch and configured to generate a pixel signal according to the pixel datum.

13. The display device of claim 12, wherein the driving circuit is a CMOS (complementary metal oxide semiconductor) inverter.

14. The display device of claim 12, wherein the first electrode and the second electrode are separated from each other, the display medium is disposed between the first electrode and the second electrode, and the pixel datum is outputted to the first electrode.

15. The display device of claim 14, wherein the display medium comprises at least one of self-luminous medium material, non-self-luminous medium material, light-filtering material, electric conductive material, insulating material, light absorbing material, light reflecting material, photorefractive material, light deflecting material, light polarizing material and light diffusing material.

16. The display device of claim 11, wherein the first electrode and the second electrode are separated from each other, the display medium is disposed between the first electrode and the second electrode, and the pixel signal is outputted to the first electrode through the driving circuit.

17. The display device of claim 16, wherein the display medium comprises at least one of self-luminous medium material, non-self-luminous medium material, light-filtering material, electric conductive material, insulating material, light absorbing material, light reflecting material, photorefractive material, light deflecting material, light polarizing material and light diffusing material.

18. The display device of claim 11 further comprising a power driver coupled to driving circuits of the plurality of pixel circuits, and configured to supply a high voltage, a common voltage and a low voltage to the driving circuits of the plurality of pixel circuits;

wherein the common voltage is an average of the high voltage and the low voltage.

19. The display device of claim 11, wherein the source driver comprises:

a plurality of shift registers configured to shift a clock signal;

a plurality of input registers coupled to the shift registers, and configured to receive image data according to the clock signal; and a plurality of data latches coupled to the input registers, and configured to latch the image data received from the input registers according to a load signal.

20. The display device of claim 19, wherein the source driver further comprises:

a plurality of driving circuits coupled to the pulse width modulation generators and the data lines, and configured to generate the pixel data to the data lines according to the PWM signals.

21. The display device of claim 11, wherein the display device is a liquid crystal display (LCD), and the PWM generator comprises an inversion controller configured to selectively use row, column and dot inversion frame mode to drive the LCD.

* * * * *